US011384412B2

(12) United States Patent
Ricketts

(10) Patent No.: US 11,384,412 B2
(45) **Date of Patent: *Jul. 12, 2022**

(54) DIRECT SCANDIUM ALLOYING

(71) Applicant: Scandium International Mining Corporation, Sparks, NV (US)

(72) Inventor: Nigel Ricketts, Mount Crosby (AU)

(73) Assignee: Scandium International Mining Corporation, Sparks, NV (US)

( * ) Notice: Subject to any disclaimer, the term of this patent is extended or adjusted under 35 U.S.C. 154(b) by 648 days.

This patent is subject to a terminal disclaimer.

(21) Appl. No.: 16/249,889

(22) Filed: Jan. 16, 2019

(65) Prior Publication Data

US 2019/0218645 A1 Jul. 18, 2019

Related U.S. Application Data

(60) Provisional application No. 62/618,064, filed on Jan. 16, 2018, provisional application No. 62/618,069, filed on Jan. 16, 2018.

(51) Int. Cl.

| | |
|---|---|
| ***C22C 21/00*** | (2006.01) |
| ***C22C 1/02*** | (2006.01) |
| ***B22D 1/00*** | (2006.01) |

(52) U.S. Cl.

CPC ..... *C22C 1/026* (2013.01); *B22D 1/00* (2013.01); *C22C 21/00* (2013.01)

(58) Field of Classification Search

CPC ..... B22D 1/00; C22C 1/026; C22C 21/00
USPC ..... 420/528
See application file for complete search history.

(56) References Cited

U.S. PATENT DOCUMENTS

| | | | | |
|---|---|---|---|---|
| 3,619,181 | A | 11/1971 | Willey | |
| 4,689,090 | A | 8/1987 | Sawtell et al. | |
| 5,037,608 | A | 8/1991 | Tarcy et al. | |
| 5,238,646 | A | 8/1993 | Tarcy et al. | |
| 5,597,529 | A | 1/1997 | Tack | |
| 6,711,819 | B2 | 3/2004 | Stall et al. | |
| 10,988,830 | B2 * | 4/2021 | Ricketts | C22C 21/00 |

(Continued)

FOREIGN PATENT DOCUMENTS

| | | | |
|---|---|---|---|
| AU | 201572 | A1 | 10/2014 |
| CN | 1184356 | C | 1/2005 |

(Continued)

OTHER PUBLICATIONS

Hua Xie, Jie Wang, Zhengbo Qin, Lei Shi, Zichao Tang, and Xiaopeng Xing, 'Octacoordinate Metal Carbonyls of Lanthanum and Cerium: Experimental Observation and Theoretical Calculation', J. Phys. Chem. A (2014), 118, 9380-9385.

(Continued)

*Primary Examiner* — Jie Yang
(74) *Attorney, Agent, or Firm* — John A. Fortkort; Fortkort & Houston PC

(57) ABSTRACT

A method is provided for forming a metal alloy. The method includes preparing a mixture of scandium oxide and a flux, thereby obtaining a flux-oxide mixture, wherein the flux contains less than 20% fluoride by weight, based on the total weight of the flux; mixing the flux-oxide mixture with molten aluminum, thereby obtaining a flux-metal mixture; cooling the flux-metal mixture; and separating at least a portion of the flux from the flux-metal mixture, thereby obtaining a metal alloy.

16 Claims, 1 Drawing Sheet

(56) References Cited

U.S. PATENT DOCUMENTS

| | | | | |
|---|---|---|---|---|
| 2011/0070120 | A1 | 3/2011 | Kim et al. | |
| 2015/0232065 | A1* | 8/2015 | Ricci | B60H 1/00742 701/36 |
| 2018/0030577 | A1* | 2/2018 | Duyvesteyn | C22C 21/00 |

FOREIGN PATENT DOCUMENTS

| | | | |
|---|---|---|---|
| CN | 100410400 | C | 8/2008 |
| CN | 100417930 | C | 9/2008 |
| CN | 101941122 | B | 8/2012 |
| CN | 102220502 | B | 11/2012 |
| CN | 102653829 | B | 11/2013 |
| CN | 105886850 | A | 8/2016 |
| CN | 106987735 | A | 7/2017 |
| CN | 107868888 | A | 4/2018 |
| CN | 107974597 | A | 5/2018 |
| EP | 2298944 | B1 | 7/2013 |
| JP | 4224532 | B2 | 2/2009 |
| RU | 1580826 | A1 | 6/1999 |
| RU | 2211872 | C1 | 9/2003 |
| RU | 2213795 | C1 | 10/2003 |
| RU | 2002106416 | A | 10/2003 |
| RU | 2361941 | C2 | 7/2009 |
| RU | 2426807 | C2 | 3/2011 |
| RU | 2421537 | C2 | 6/2011 |
| RU | 2507291 | C1 | 2/2014 |
| RU | 2587700 | C1 | 6/2016 |
| RU | 2593246 | C1 | 8/2016 |
| SU | 1348122 | A1 | 10/1987 |
| WO | 2006079353 | A1 | 8/2006 |

OTHER PUBLICATIONS

P. C. Feijoo, A. del Prado, M. Toledano-Luque, E. San Andrés, and M. L. Lucía, "Scandium oxide deposited by high-pressure sputtering for memory devices: Physical and interfacial properties", Journal of Applied Physics 107, 084505 (2010).

Skachkov, Vladimir & Varchenya, P.A. & Ovsyannikov, Boris & Yatsenko, S.P. (2013), "Injection of scandium-containing process powders into aluminum alloys", Tsvetnye Metally. 81-86. (English Abstract).

"Synthesis and Properties of Aluminum Master-Alloy With Scandium, Zirconium and Hafnium".

B. P. Kulikov, V. N. Baranov, A. I. Bezrukikh, V. B. Deev, and M. M. Motkov, "Preparation of Aluminum-Scandium Waster Alloys by Aluminothermal Reduction of Scandium Fluoride Extracted from Sc2O3", Metallurgist, vol. 61, Nos. 11-12, Mar. 2018 (Russian Original Nos. 11-12, Nov.-Dec. 2017).

Yuriy Shtefanyuk, Victor Mann, Vitaliy Pingin, Dmitriy Vinogradov, Yuriy Zaikov, Olga Tkacheva, Andrey Nikolaev, Andrey Suzdaltsev, "Production Of Al—Sc Alloy By Electrolysis of Cryolite-Scandium Oxide Welts", TMS (The Minerals, Metals & Materials Society) (Mar. 2015).

Hidenori Fujii, Hiroomi Akiyama1, Junichi Kaneko, Makoto Sugamata and Ludwik Blaz, "Al—Sc Master Alloy Prepared by Mechanical Alloying of Aluminum with Addition of Sc2O3", Materials Transactions, vol. 44, No. 5 (2003) pp. 1049 to 1052.

V. M.Skachkov, L.A.Pasechnik, S.P.Yatsenko, "Introduction of Scandium, Zirconium and Hafnium Into Aluminum Alloys, Dispersion Hardening ofi Ntermetallic Compounds With Nanodimensional Particles", Nanosystems: Physics, Chemistry, Mathematics (2014), 5(4),p. 603 {612).

A. H. Ratner, M. B. Geilikman, S. V. Aleksandrovski, "Thermodynamic calculation on metallic thermoreduction during preparation of aluminum rare master alloys", Trans. Nonferrous Met. Soc. China (Feb. 2001), vol. 11, No. 1.

O. Yu. Tkachevaa, I. G. Brodovab, P. A. Arhipova, and Yu. P. Zaikov, "Influence of Crystallization Conditions on the Structure and Modifying Ability of Al—Sc Alloys", Russian Journal of Non-Ferrous Metals (2017), vol. 58, No. 1, pp. 67-74.

Masanori Harata, Takao Nakamura, Hiromasa Yakushiji, Toru H. Okabe, "Production of Scandium and Al—Sc Alloy by Metallothermic Reduction", Journal Mineral Processing and Extractive Metallurgy Transactions of the Institutions of Mining and Metallurgy: Section C vol. 117 (2008)—Issue 2.

A. Varchenya, P & Ovsyannikov, Boris & P. Yatsenko, S & Sabirzyanov, N & Pasechnik, Liliya, "Synthesis and Properties of Aluminum Master-Alloy With Scandium, Zirconium and Hafnium", First International Congress, Non-Ferrous Metals of Siberia, Part 3—Non-Ferous and Rare Metals Production (2009).

Skachkov, Vladimir & Yatsenko, S.P. "Obtaining of Sc, Zr, Hf and Y base metals on the basis of aluminum by method of high-temperature exchange reactions in salt melts", (2014) 22-26 (English Summary).

* cited by examiner

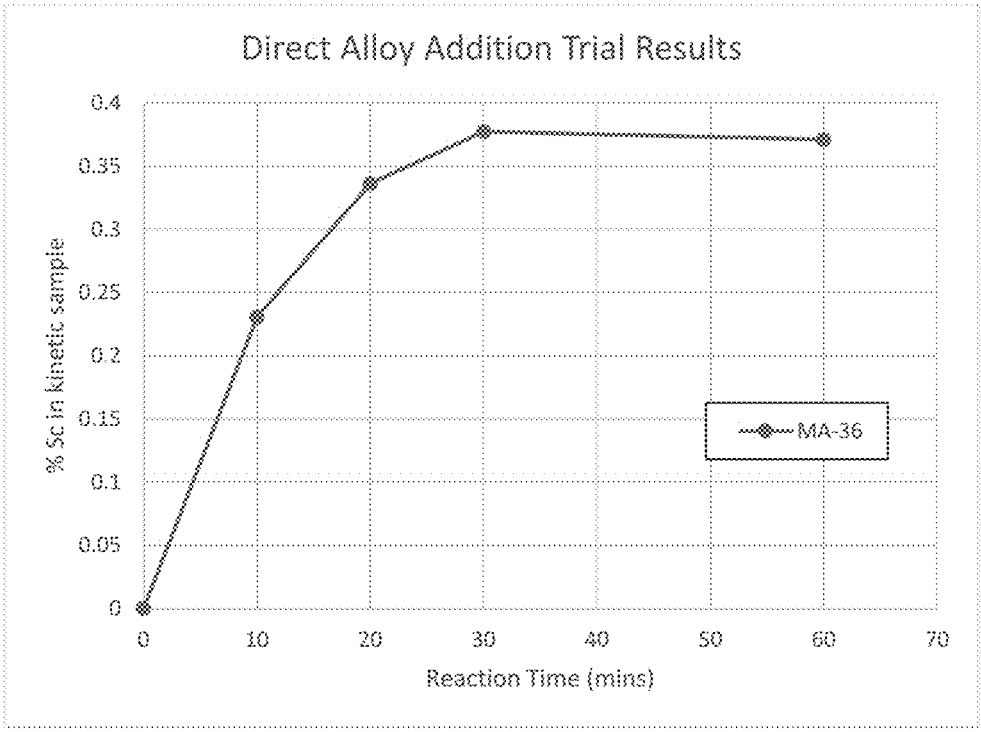
Direct Alloy Addition Trial Results
% Sc in kinetic sample
0.4
0.35
0.3
0.25
0.2
0.15
0.1
0.05
0
0
10
20
30
40
50
60
70
Reaction Time (mins)
MA-36

DIRECT SCANDIUM ALLOYING

CROSS-REFERENCE TO RELATED APPLICATION

This application claims the benefit of priority from U.S. provisional application No. 62/618,064, filed Jan. 16, 2018, having the same inventor, and the same title, and which is incorporated herein by reference in its entirety. This application also claims the benefit of priority from U.S. provisional application No. 62/618,069, filed Jan. 16, 2018, having the same inventor, and the same title, and which is incorporated herein by reference in its entirety.

FIELD OF THE DISCLOSURE

The present disclosure relates generally to systems and methodologies for forming scandium alloys, and more particularly to systems and methodologies for the direct addition of scandium to metal alloys.

BACKGROUND OF THE DISCLOSURE

Recently, several advances have been made in the synthesis of scandium-aluminum alloys. These include, for example, those described in WO2016/130426 (Duyvesteyn), entitled "SCANDIUM-CONTAINING MASTER ALLOYS AND METHODS FOR MAKING THE SAME". In an embodiment of the methodology described therein, a scandium-containing precursor is mixed with a molten metal containing aluminum. The precursor undergoes thermal decomposition to produce scandium oxide, which reacts with the aluminum to produce a scandium-aluminum alloy.

Scandium oxide is the most traded form of scandium. This is due to the fact that scandium recovery processes commonly utilize scandium oxalate precipitation (due to its high selectivity over a number of possible impurity elements), and the fact that the resulting scandium oxalate (commonly in the form of the pentahydrate salt) is typically calcined to produce scandium oxide.

The addition of scandium oxide to aluminum alloys to produce scandium-containing aluminum alloys is not thermodynamically favorable. Nonetheless, it can proceed via the reaction below due to the typically low activity of scandium in molten aluminum alloys:

$$Sc_2O_3+2Al \rightarrow 2Sc_{[Al]}+Al_2O_3$$

The addition of scandium to aluminum alloys is most commonly implemented through the addition of a 2% Sc—Al master alloy to the molten metal. In order to produce such a master alloy from scandium oxide, approximately 4% by weight of scandium oxide of the aluminum content of the alloy is required. This produces a similar amount of aluminum oxide as a by-product. Such a large amount of aluminum oxide by-product is detrimental to the physical quality of the scandium-aluminum master alloy and the aluminum alloys it is subsequently added to.

In order to remove aluminum oxide from aluminum alloys, most aluminum processing operations either add in a low-melting point flux (which is usually a combination of alkali metal halides), inject inert gases into the melt, or do both. The oxides preferentially wet the flux rather than the metal, and hence, the subsequent physical separation of the flux and metal removes the oxide from the alloy.

The 4% aluminum oxide by-product attendant to the formation of the master alloy is well above the levels of aluminum oxide that are normally dealt with in aluminum processing operations. Consequently, the choice of flux is critical. Moreover, a substantial mass of flux (around 10% of the mass of the aluminum) will typically be required. Unfortunately, when scandium oxide is added to aluminum alloys in the presence of such a flux, a portion of the scandium oxide may also get caught up in the flux, thus preventing it from reacting with the aluminum alloy. This problem is exacerbated as the amount of flux increases.

One known method for adding scandium to aluminum alloys is to first convert the scandium oxide to scandium fluoride, which reacts with molten aluminum more easily than does scandium oxide. This is typically accomplished by reacting the scandium oxide with hot hydrogen fluoride gas at high temperatures. This approach is both dangerous and technically difficult, given the high toxicity and reactivity of hydrogen fluoride gas.

U.S. Pat. No. 5,037,608 (Tarcy et al.) discloses a method for adding scandium oxide to aluminum alloys by pre-compacting aluminum powder and scandium oxide powder together. This addition was conducted in the absence of a flux, which would have needed to be added in the post-processing stage to clean the aluminum oxide from the aluminum alloy.

Skachkov, V. M., Varchenya, P. A., Ovsyannikovm B. V. and Yatsenko, S. P. (2013), "Injection of scandium-containing process powders into aluminum alloys", Tsvetnye Metally, 12, (January 2013), describes research performed on a method for adding scandium oxide or scandium fluoride to molten aluminum by a flux injection process. In the approach described therein, a range of halide-based flux elements were added to molten aluminium, along with scandium oxide and/or scandium fluoride, to produce an approximately 0.1% Sc—Al alloy. The authors state that, for sodium sensitive alloys, calcium fluoride and calcium chloride can be used instead of sodium and potassium salts. This work is further detailed in Skachkov, V. M., Pasechnik, L. A. and Yatsenko, S. P., "Introduction of scandium, zirconium and hafnium into aluminum alloys, Nanosystems: Physics, Chemistry, Mathematics" 5 (4) (2014) 603-612, where zirconium and hafnium oxides are added to the molten alloy in addition to scandium oxide. The powder preparation method described therein includes forming and pre-drying a mixture of potassium chloride (50-60%), potassium fluoride (30-45%) and aluminum fluoride (5-10%), and then grinding the salts into a mixture with 10-25% of the required oxide. The ground mixture is added to the melt at 750-800° C., with the use of $CO_2$ as an injecting gas. Gas blowing is said to occur for 1-5 minutes, after which casting takes place.

Although the method described in the foregoing Skachkov references appears to be relatively rapid, the pre-treatment of the powders and grinding together, when combined with a gas injection system, significantly complicates the alloying process. Moreover, the high concentration of potassium and aluminum fluoride in the flux adds to the expense of the process.

Varchenya, P. A. et al., "Synthesis and Properties of Aluminum Master-Alloy with Scandium, Zirconium and Hafnium", First International Congress, Non-Ferrous Metals of Serbia (2009), Part III, 421-424, examined the use of both scandium fluoride and scandium oxide for the production of Al—Sc master alloys. Recoveries of 96% were achieved with scandium fluoride, compared to only 80% with scandium oxide. The flux mixtures comprised mostly potassium chloride and sodium fluoride, although in some tests, aluminum fluoride was added. The addition of aluminum fluoride was said to enhance the coalescence of aluminum metal droplets. Stirring (described as "intensive") was conducted for 15-20 minutes.

Ratner et al, "Thermodynamic Calculation of Metallic Thermoreduction During Preparation of Aluminium-Rare Master Alloys", Trans Nonferrous Met Soc. China, 11 (1), 18-21 (February 2001) examined the thermodynamics and equilibrium conditions for aluminothermic reduction of scandium oxide, scandium chloride and scandium fluoride. The authors concluded that magnesium was the best reduction agent for metallothermic reduction of scandium chemicals.

SUMMARY OF THE DISCLOSURE

In one aspect, a method is provided for forming a metal alloy. The method comprises preparing a mixture of scandium oxide and a flux, thereby obtaining a flux-oxide mixture, wherein the flux contains less than 20% fluoride by weight, based on the total weight of the flux; mixing the flux-oxide mixture with molten aluminum, thereby obtaining a flux-metal mixture; cooling the flux-metal mixture; and separating at least a portion of the flux from the flux-metal mixture, thereby obtaining a metal alloy.

In another aspect, a method is provided for forming a metal alloy. The method comprises producing a first molten metal having a temperature of at least 780° C., wherein the first molten metal is selected from the group consisting of aluminum and aluminum alloys; preparing a mixture of scandium oxalate and a flux, thereby obtaining a flux-oxalate mixture; adding the flux-oxalate mixture to the first molten metal, thereby obtaining a second molten metal; and stirring the second molten metal.

In a further aspect, a method is provided for forming a metal alloy. The method comprises preparing a mixture of scandium oxalate and a flux, thereby obtaining a flux-oxalate mixture; melting the flux-oxalate mixture to produce a fused product; producing a first molten metal having a temperature of at least 780° C., wherein the first molten metal is selected from the group consisting of aluminum and aluminum alloys; adding the fused product to the first molten metal, thereby obtaining a second molten metal; and stirring the second molten metal.

BRIEF DESCRIPTION OF THE DRAWINGS

FIG. 1 is a graph of % Sc as a function of reaction time for a trial run of a method featuring the direct addition of scandium to an aluminum alloy.

DETAILED DESCRIPTION

Scandium oxalate precipitation is known to be very selective over a number of possible impurity elements, and hence is widely used in scandium purification techniques. Moreover, the precipitated scandium oxalate pentahydrate may be readily calcined to produce scandium oxide. Partly for this reason, most scandium production methods are designed to produce scandium oxide as the main product, and scandium oxide is the most commonly traded form of scandium.

The production of scandium-containing aluminum alloys through the addition of scandium oxide to aluminum alloys is not a thermodynamically favourable process. However, the low activity of scandium in the molten alloy allows it to proceed via the reaction below:

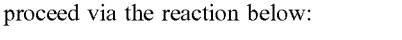

$$Sc_2O_3+2Al \rightarrow 2Sc_{[Al]}+Al_2O_3$$

At present, scandium is often added to molten aluminum alloys as a 2% Sc—Al master alloy. The production of the master alloy requires high temperatures (approaching 900° C. for an extended period of time) in order to achieve a 2% Sc level. By contrast, most aluminum alloys are handled at temperatures lower than 800° C., and only have scandium additions of 0.1-0.3% Sc.

Various attempts have been made in the art to address the issue of adding scandium to aluminum alloys using a scandium oxide material. For example, in some known processes, scandium is added to aluminum alloys by converting scandium oxide to scandium fluoride, the latter of which reacts with molten aluminum more easily. Typically, the foregoing conversion is achieved by reacting scandium oxide with hot hydrogen fluoride gas at high temperatures. This reaction is both dangerous and technically challenging, since hydrogen fluoride gas is highly toxic and (especially at elevated temperatures) very reactive.

It has now been found that the foregoing issues may be avoided by the direct addition of scandium oxide to aluminum alloys via a flux procedure described herein. This flux procedure does not require a master alloy. In preferred embodiments of the systems, methodologies and compositions described herein, the flux utilized contains a salt mixture which comprises less than 20% fluorides by weight, with the remainder of the salt mixture comprising inexpensive chloride salts. Without wishing to be bound by theory, this composition is believed to make the salt mixture less hygroscopic and more capable of carrying the dissolved/dispersed aluminum oxide by-product generated by addition of scandium oxide to an aluminum alloy.

The preferred embodiment of the methodology disclosed herein also differs from some or all of the methods known to the prior art in that it requires minimal or no agitation of the molten mixture after addition of the flux, aside from an initial stirring. This is in contrast to, for example, the methodology of Varchenya, where vigorous mixing is employed. Such mixing not only complicates the overall process and requires specialized equipment, but may also inhibit the separation of flux from the molten metal.

The preferred embodiment of the methodology disclosed herein also differs from some or all of the methods known to the prior art in that, while pre-mixing of the salt and oxide are preferred, pre-grinding of these materials is not necessary, and no gas injection system is required. Very high levels of recovery of scandium from scandium oxide are possible with preferred embodiments of the method, with scandium recoveries approaching 100% recovery in some cases. Finally, simple scandium addition calculations may be utilized, with the addition of a known amount of pre-prepared flux to achieve a required scandium content in the alloy.

The following specific, non-limiting examples further illustrate the methodologies and compositions disclosed herein.

EXAMPLE 1

In this example, 126 grams of aluminum were melted in a graphite crucible at a temperature of 780° C. To the molten aluminium, a pre-mixed salt mixture was added which contained 0.72 grams of scandium oxide, 0.72 grams of potassium cryolite, 3.60 grams of sodium chloride, and 3.60 grams of potassium chloride.

The flux mixture was immediately stirred into the molten aluminum after addition. The mixture of flux and metal was stirred for approximately 2 seconds with a stainless-steel rod that had been pre-coated with boron nitride suspension. The stirring was repeated every 10 minutes for one hour, and then the metal was cast into a steel mould. The cast ingot weighed 125.1 grams.

Ingot shavings from the cast ingot were subject to inductively coupled plasma optical emission spectrometry (ICP-OES) chemical analysis. The ingot analysis revealed that the shavings contained 0.55% Sc. This represents a recovery of almost 100%, within the error of the sampling method and analysis method.

EXAMPLE 2

In this example, 122 grams of aluminum were melted in a graphite crucible at a temperature of 780° C. To the molten aluminium, 9.2 grams of a pre-mixed salt flux containing a mixture of alkali metal halides and scandium oxide was added. The flux mixture was immediately stirred into the molten aluminum after addition. The mixture of flux and metal was stirred for approximately 2 seconds with a stainless-steel rod that had been pre-coated with boron nitride suspension.

After 10 minutes of settling, a sample of the metal was sucked into a borosilicate glass tube that had been pre-coated in a boron nitride suspension. The metal was stirred again (in the manner previous described), and samples were taken (in the manner previously described) at 10, 20, 30 and 60 minutes after addition of the salt flux to the molten metal. The residual aluminum was poured into a steel mould. A thin adherent layer of semi-molten salt was found on the crucible walls at the end of the trial, which was easily removed by scraping it from the crucible walls whilst still hot.

The cast "pin" samples were subject to ICP-OES chemical analysis. The results of this analysis are shown in FIG. 1. As seen therein, the reaction was found to be essentially complete after 30 minutes. Recovery of scandium to the aluminum alloy was 100%, and recovery of aluminum in the process was 98%. The final assay result of the 60-minute sample was 0.37% Sc by weight.

In preferred embodiments of the methodologies described herein, the flux is premixed with the oxides prior to being added to the melt. Pre-fusing of the flux-oxide mixture is preferred, after which the resulting flux/oxide mixture may be poured into a suitable casting device.

The preferred embodiments of the methodologies described herein require minimal or no stirring, aside from an initial stirring performed when the flux is first blended with the molten metal. Instead, in such embodiments, intermittent manual stirring (or the equivalent stirring one would automatically achieve with induction furnace melting operations) may be utilized.

In some embodiments, the thermal degradation of precursors may be utilized to generate gases in situ that may serve to self-agitate the molten mixture. For example, in one preferred embodiment, scandium oxalate ($Sc_2(C_2O_4)_3$) may be added to a molten metal (such as, for example, a metal selected from the group consisting of Al, Mg or an alloy of the foregoing), either alone or in combination with a flux mixture of the type described herein.

Preferably, the molten metal mixture is maintained at a temperature within the range of 665° C.-830° C. after the addition of the flux-oxide mixture, more preferably at a temperature within the range of 700° C.-800° C., and most preferably at a temperature within the range of 750° C.-780° C. The molten metal mixture is preferably maintained at these temperatures for at least 10 minutes, more preferably at least 20 minutes, and most preferably at least 30 minutes.

In some embodiments, additional elements may be added to the resulting alloy by adding suitable precursors to the flux mixture. For example, rare earth oxides may be added to the flux mix to introduce rare earths into the alloy. Fluoroborates may be added to the flux mix to introduce boron into the alloy, and fluorotitanates may be added to the flux mix to introduce titanium into the alloy. Similarly, zirconium oxides, niobium oxides or hafnium oxides may be added to the flux mix to respectively introduce zirconium, niobium or hafnium into the alloy. Of course, it will be appreciated that various combinations and sub-combinations of the foregoing may be added to introduce combinations of these metals into the final alloy.

It will be appreciated that scandium-bearing aluminum alloys (and especially master alloys) may be made with the systems and methodologies disclosed herein which have different percentages by weight of scandium in the alloy. Thus, for example, the percent by weight of scandium in the scandium-bearing alloy is typically at least 0.5%, preferably at least 1%, more preferably at least 1.5%, and most preferably at least 2%.

The flux-metal mixture may be maintained in a molten state for various amounts of time in embodiments of the systems and methodologies disclosed herein. Preferably, the flux-metal mixture is maintained in a molten state for at least 20 minutes, more preferably at least 40 minutes, and most preferably at least 60 minutes.

In preferred embodiments of the systems and methodologies disclose herein, a metal mixture is formed and is maintained in a molten state. This preferably includes maintaining the mixture at a temperature within the range of 750° C. to 1000° C., more preferably at a temperature within the range of 800° C. to 950° C., and most preferably at a temperature within the range of 850° C. to 900° C.

In some embodiments of the systems and methodologies disclosed herein, it is desirable to mixing the flux-oxide mixture with a first portion of molten metal. In some embodiments, this may include placing the first flux at the bottom of a container, placing a portion of the metal over the first flux, and melting the portion of metal to form the first portion of molten metal. In other embodiments, this may involve placing the first flux at the bottom of a container and pouring the first portion of molten metal over the first flux.

In some embodiments of the systems and methodologies disclosed herein, after the flux-oxide mixture is added to the first portion of molten metal, a second flux is added to the molten metal. Preferably, the second flux contains at least one alkali metal chloride, which is preferably selected from the group consisting of sodium chloride and potassium chloride. Preferably, the second flux contains a mixture of at least first and second alkali metal chlorides, and more preferably, the second flux contains a mixture of sodium chloride and potassium chloride.

In some embodiments of the systems and methodologies disclosed herein, the flux-oxide mixture may be fused prior to being mixed with a first portion of molten metal. In such embodiments, the fused flux-oxide mixture may be mixed with the first portion of molten metal as a liquid. The resulting flux-metal mixture may be mixed using any suitable mixing device or technique including, for example, the use of a mechanical agitation device or induction heating.

Some embodiments of the systems and methodologies disclosed herein make advantageous use of a master alloy. In such embodiments, the master alloy may be produced without mechanical alloying, and/or without electrolysis. Moreover, in such embodiments, a scandium-containing master alloy may be obtained from the flux-metal mixture by a process which includes cooling the flux-metal mixture, and separating at least a portion of the flux from the cooled flux-metal mixture, or separating at least a portion of the flux from the flux-metal mixture, and then cooling the flux-metal mixture.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims. In these claims, absent an explicit teaching otherwise, any limitation in any dependent claim may be combined with any limitation in any other dependent claim without departing from the scope of the invention, even if such a combination is not explicitly set forth in any of the following claims.

What is claimed is:

1. A method for forming a metal alloy, comprising:

producing a first molten metal having a temperature of at least 780° C., wherein the first molten metal is selected from the group consisting of aluminum and aluminum alloys;

preparing a mixture of scandium oxalate and a flux, thereby obtaining a flux-oxalate mixture;

adding the flux-oxalate mixture to the first molten metal, thereby obtaining a second molten metal; and stirring the second molten metal;

wherein the second molten metal is stirred only after at least 85% of the at least one gaseous byproduct has been evolved.

2. The method of claim 1, wherein adding the flux-oxalate mixture to the first molten metal generates at least one gaseous byproduct.

3. The method of claim 2, wherein the second molten metal is stirred only after at least 90% of the at least one gaseous byproduct has been evolved.

4. The method of claim 2, wherein the second molten metal is stirred only after at least 95% of the at least one gaseous byproduct has been evolved.

5. The method of claim 2, wherein the at least one gaseous byproduct is selected from the group consisting of carbon monoxide and carbon dioxide.

6. The method of claim 1, wherein adding the flux-oxalate mixture to the molten metal includes applying the flux-oxalate mixture to the surface of the molten metal.

7. A method for forming a metal alloy, comprising:

preparing a mixture of scandium oxalate and a flux, thereby obtaining a flux-oxalate mixture;

melting the flux-oxalate mixture to produce a fused product;

producing a first molten metal having a temperature of at least 780° C., wherein the first molten metal is selected from the group consisting of aluminum and aluminum alloys;

adding the fused product to the first molten metal, thereby obtaining a second molten metal; and stirring the second molten metal;

wherein the fused product is added to the first molten metal only after at least 85% of the at least one gaseous byproduct has been evolved.

8. The method of claim 7, wherein melting the flux-oxalate mixture includes heating the flux-oxalate mixture to a temperature within the range of 700–900° C.

9. The method of claim 7, wherein melting the flux-oxalate mixture generates at least one gaseous byproduct.

10. The method of claim 9, wherein the fused product is added to the first molten metal only after at least 90% of the at least one gaseous byproduct has been evolved.

11. The method of claim 9, wherein the fused product is added to the first molten metal only after at least 95% of the at least one gaseous byproduct has been evolved.

12. The method of claim 9, wherein the at least one gaseous byproduct is selected from the group consisting of carbon monoxide and carbon dioxide.

13. The method of claim 7, further comprising:

stirring the molten flux-oxalate mixture.

14. The method of claim 7, wherein the flux-oxalate mixture is melted in a vessel equipped to retain calcining oxalate.

15. The method of claim 7, further comprising:

pouring the fused product onto a surface; and allowing the poured, fused product to cool.

16. The method of claim 15, wherein adding the fused product to the first molten metal includes applying the fused product to the surface of the molten metal.

* * * * *